US006547285B1

(12) United States Patent
Schoenweger et al.

(10) Patent No.: US 6,547,285 B1
(45) Date of Patent: Apr. 15, 2003

(54) FIXING ARRANGEMENT FOR SANITARY COMPONENTS

(75) Inventors: Alois Schoenweger, Schiltach (DE); Bernd Kronenbitter, Alpirsbach-Roemlinsdorf (DE)

(73) Assignee: Hansgrohe AG, Schiltach (DE)

( * ) Notice: Subject to any disclaimer, the term of this patent is extended or adjusted under 35 U.S.C. 154(b) by 0 days.

(21) Appl. No.: 09/454,667

(22) Filed: Dec. 3, 1999

(30) Foreign Application Priority Data

Dec. 5, 1998 (DE) ..... 198 56 156

(51) Int. Cl.[7] ..... G01F 15/08; F16L 43/00

(52) U.S. Cl. ..... 285/64; 285/30; 285/119; 285/61

(58) Field of Search ..... 285/30, 64, 215, 285/216, 61, 119, 133.11, 133.21; 137/358, 359

(56) References Cited

U.S. PATENT DOCUMENTS

| | | | | | |
|---|---|---|---|---|---|
| 2,716,566 | A | * | 8/1955 | Thiry | 267/153 |
| 2,735,699 | A | * | 2/1956 | Chadbourne | 285/133.11 |
| 3,008,735 | A | * | 11/1961 | Wijngaarden | 248/340 |
| 3,406,783 | A | * | 10/1968 | Haffer | 181/247 |
| 3,645,564 | A | * | 2/1972 | Corriston | 285/133.21 |
| 3,709,527 | A | * | 1/1973 | Nations | 285/110 |
| 3,904,228 | A | * | 9/1975 | Maroschak | 285/129.1 |
| 3,937,499 | A | * | 2/1976 | Courtot | 285/319 |
| 4,410,004 | A | * | 10/1983 | Kifer et al. | 285/64 |
| 4,572,232 | A | | 2/1986 | Gruber | 137/360 |
| 4,584,723 | A | | 4/1986 | Hussauf | 4/192 |
| 4,623,170 | A | * | 11/1986 | Cornwall | 285/64 |
| 4,809,548 | A | * | 3/1989 | Rivero-Olmedo | 285/30 |
| 4,953,235 | A | * | 9/1990 | Cornwall | 285/64 |
| 5,031,940 | A | * | 7/1991 | Stefanos | 285/64 |
| 5,351,996 | A | * | 10/1994 | Martin | 285/64 |

FOREIGN PATENT DOCUMENTS

| | | |
|---|---|---|
| DE | 78 20 423 | 11/1978 |
| DE | 42 43 737 | 3/1994 |
| DE | 195 10 872 | 9/1996 |

* cited by examiner

*Primary Examiner*—Eric K. Nicholson
(74) *Attorney, Agent, or Firm*—Duane Morris LLP

(57) ABSTRACT

An arrangement for installing a sanitary fitting contains a concealed tank with passage openings to be fitted in a wall and within which can be fitted a fitting body. The connection between the fitting body and the concealed tank takes place exclusively with the aid of connecting elements made from a soundproofing material and through which pass the passage openings of the concealed tank. There is no direct contact between the concealed tank and the fitting body. Different fittings can be screwed to the fitting body. The connecting elements can be simultaneously used for the passage of water pipes.

20 Claims, 3 Drawing Sheets

FIXING ARRANGEMENT FOR SANITARY COMPONENTS

Figure 1:
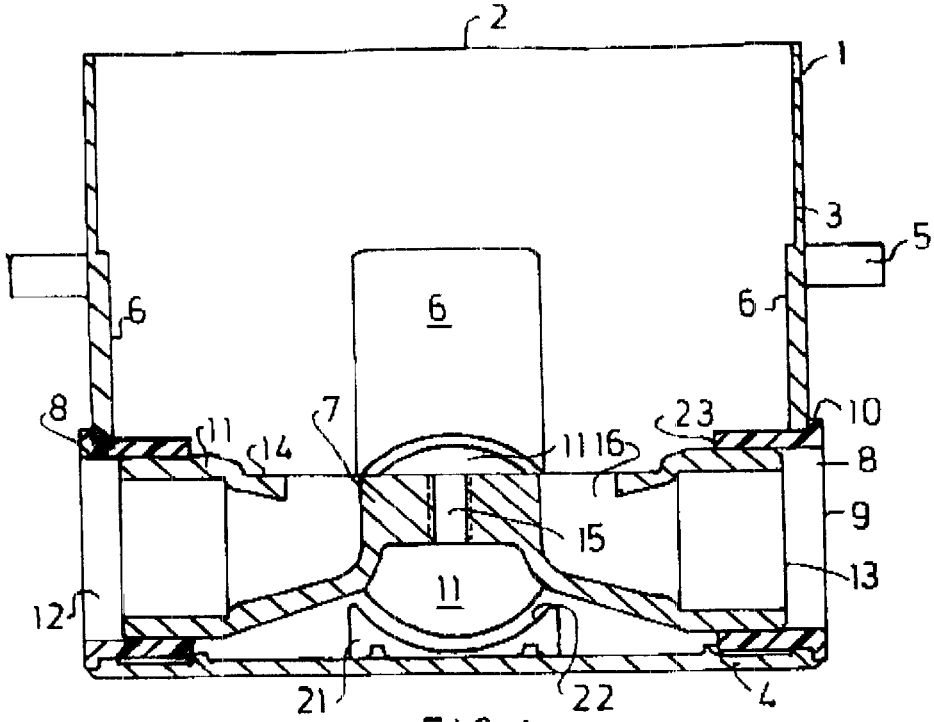

The invention is based on a so-called concealed tank with the aid of which sanitary fittings can be fitted to a wall. The concealed tank or box serves both as an installation aid and also for protecting the actual fitting during the completion of the plaster rendering and the tiling of the wall. The concealed tank can contain a fitting body to which the actual fitting can be connected after completing the pipes and tiling.

A concealed tank of this type is already known (German utility model 7820423), in which the water pipes are tightly fixed in the tank walls accompanied by the interposing of a rubber ring. Accompanied by the interposing of a soundproofing layer, the fitting body is incorporated into the tank. Externally fitted flanges serve to provide the connection between the tank and the building or structure. The fitting body is connected by means of screw couplings to the tank. This gives a sound transmission possibility, which is only partly reduced by the soundproofing layer. This sound transmission suffers from the disadvantage that it can be transmitted directly to the tank through the noise produced in the fitting or that existing in the pipe network as solid or water-borne sound and said tank can act as a resonator for sound radiation. Thus, noise is transmitted to the environment, i.e. to the structure or room.

The problem of the invention is to provide a possibility for fitting sanitary elements, in which noise transmission is reduced.

To solve this problem the invention proposes a fixing arrangement for sanitary components having the features of claim 1. Further developments of the invention form the subject matter of the dependent claims, whose wording, like that of the abstract, is, by reference, made into part of the content of the description.

The fitting body is connected to the concealed tank exclusively by means of the at least one connecting element which is built up from sound deadening material. Thus, there are no sound bridges between the tank and the fitting body. The sound deadening material can e.g. be a rubber-like material.

Also at the location of the connecting element there is no direct contact between the fitting body and the concealed tank.

According to a further development of the invention, following the insertion of the fitting body in the concealed tank the connecting element is connectable to the latter. The fitting body is designed in such a way that it can be introduced into the concealed tank from the open side thereof. It should be ensured that there is only a limited clearance between the outside of the fitting body and the concealed tank. Following insertion the one or more connecting elements can be connected to the concealed tank, preferably from the outside of the latter.

According to a further development, the connecting element is inserted in a through opening of the concealed tank to whose edge it is connected.

According to a further development of the invention, the connecting element is hollow and is particularly constructed as a sleeve.

According to a further development of the invention, the connecting element is constructed in such a way that the connection between it and the fitting body takes place in an opening. This makes it possible to ensure that relatively large surface areas between the connecting element and the fitting body are used for fixing purposes.

According to the invention, a lug of the fitting body engages in the sleeve-like connecting element.

However, it is also possible for the connecting element to engage in a sleeve-like lug of the fitting body.

To facilitate installation the concealed tank can have a supporting device, a mounting device or the like for the fitting body and which is positioned in such a way that the fitting body is held in the concealed tank in the vicinity of its final position.

Thus, as stated, during installation the fitting body is inserted in the tank until it is supported by the supporting device. This can be followed by the connection to the connecting element. It may be necessary for this purpose to move the fitting body somewhat upwards or to the side, which can take place using simple aids.

However, it is particularly advantageous if during the production of the complete engagement between the connecting element and the fitting body the latter is removed from the supporting device by the engagement of the connecting element. Thus, without further action or support the fitting body is released from the supporting device and consequently also from the concealed tank, so that there is no longer any direct connection.

According to a further development of the invention, the connecting element is constructed as a sealing element, which simultaneously seals the tank to the outside.

According to a further development of the invention, the fitting body has water ducts.

It can in particular be provided that the fitting body has a surface serving as an interface, to which can be fitted a surface of a sanitary fitting also serving as an interface. In the interface surface can issue at least one opening for a water duct. Thus, e.g. the water from the water pipe can flow through the fitting body to the sanitary element.

According to the invention the fitting body can have fixing openings for fitting sanitary elements, e.g. bores or holes provided with a thread.

To connect the concealed tank to the wall of a building the latter can be provided with fixing openings. The latter can be so designed that the concealed tank can e.g. be firmly screwed to the bottom of a recess in the wall. The concealed tank can also have openings with which it can be screwed to an insulating wall.

According to the invention the at least one lug of the fitting body is constructed for connection to a water pipe of a house plumbing system.

For example, the body can have an absolutely symmetrical construction, so that to it can be flanged the various sanitary elements such as single lever mixer valve, thermostats with or without reversers or other additional devices.

According to a further development of the invention, the connecting element or at least one of the connecting elements, prior to the insertion of the fitting body in the concealed tank, can be connected to the latter and/or to the fitting body.

It can in particular be provided that the connecting element or one of the connecting elements is inserted in a recess of the fitting body and/or the concealed tank. This also leads to a sound-deadened connection between the fitting body and the concealed tank.

For example, one or more connecting elements can be engaged on a projection of the fitting body and/or the concealed tank.

According to the invention the arrangement can have several connecting elements, e.g. also combinations of different types of connecting elements. For example, a sealing sleeve can be located on the underside of the tank, so as to permit there a tight passage through the tank, whereas in other areas of the casing it is possible to use other connecting elements.

Further features, details and advantages of the invention can be gathered from the following description of a preferred embodiment of the invention and from the attached drawings, wherein show:

FIG. 1 A section through a concealed tank according to the invention provided with a fitting body.

Figure 2:
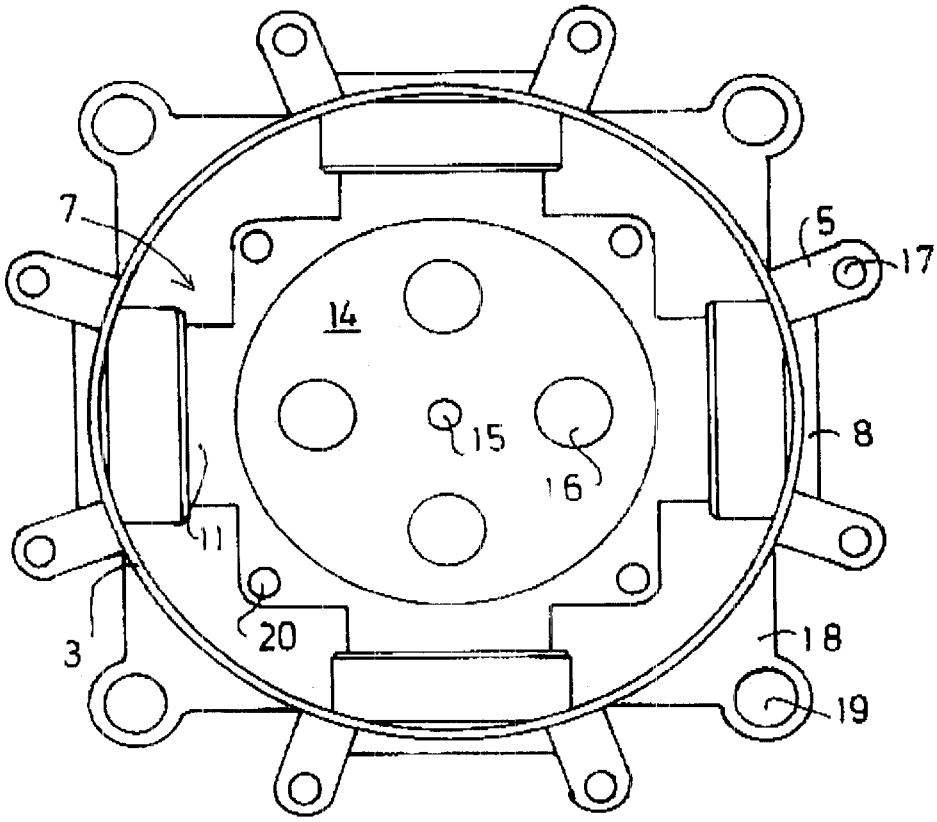

FIG. 2 A plan view of the arrangement of FIG. 1.

Figure 3:
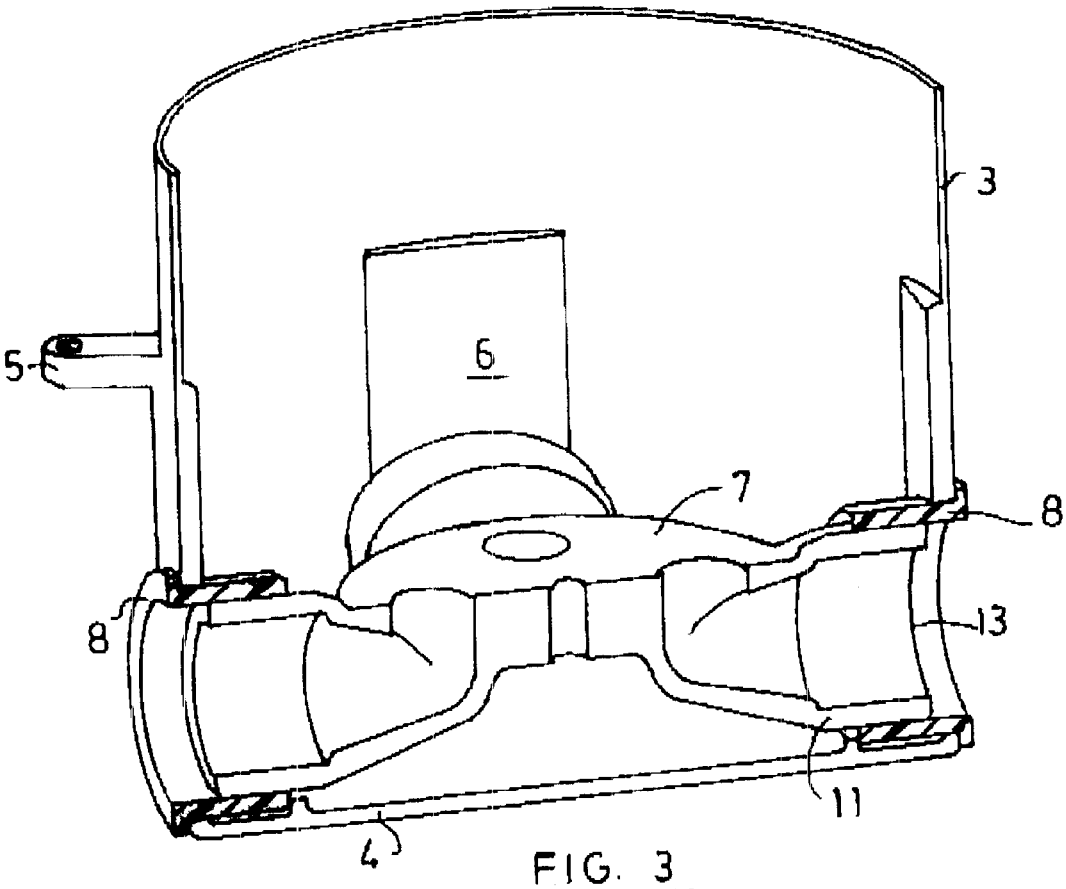

FIG. 3 Perspectively a section through the arrangement of FIG. 1.

Figure 4:
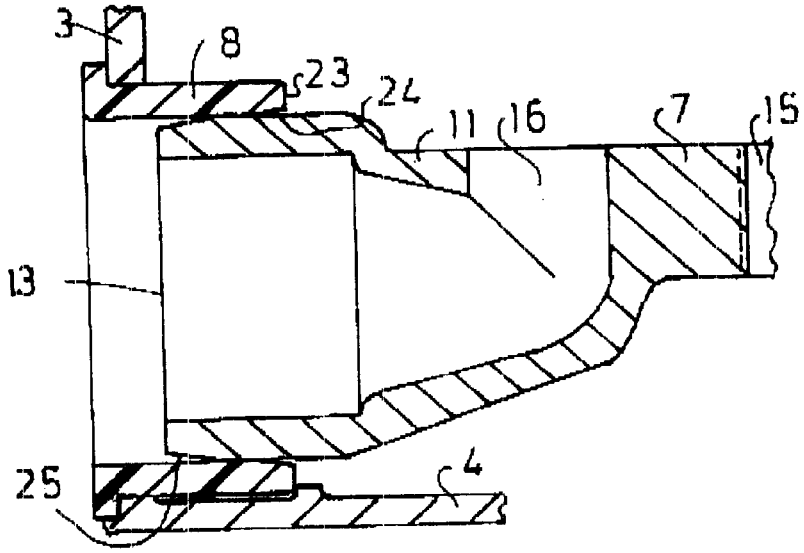

FIG. 4 On a larger scale a partial section through a connecting element connecting the concealed tank to the fitting body.

Figure 5:
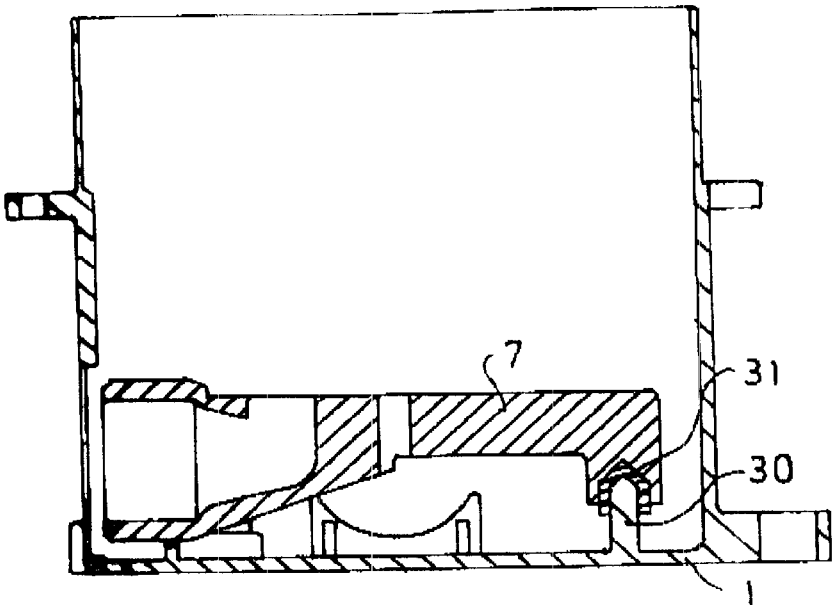

FIG. 5 A representation corresponding to FIG. 1 of another embodiment.

Figure 6:
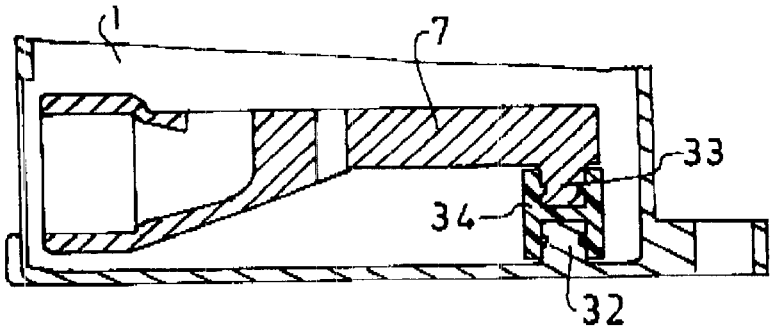

FIG. 6 A broken away representation of another embodiment.

In the section of FIG. 1 the concealed tank or box 1 is shown in a position in which its open side 2 is directed upwards. The concealed tank 1 has an e.g. circular cylindrical outer wall 3, which is terminated by a flat bottom 4. During the installation of a sanitary valve the concealed tank is normally placed in a recess of a wall in such a way that the open side 2 is vertical, i.e. directed forwards.

To the outside of the outer wall are fitted several projections 5, roughly at half the height of the tank, by means of which the latter can e.g. be screwed to an insulating wall. Further projections with fixing possibilities located in the vicinity of the bottom 4 cannot be seen in the sectional view of FIG. 1, but are visible in the plan view of FIG. 2.

At a short distance from the bottom 4, the wall 3 of the concealed tank 1 has a total of four passage openings, which e.g. all have the same diameter and which are circular. At the inside of the wall 3 in the vicinity of said openings the wall thickness is modified in such a way that planar or flat surfaces 6 are obtained.

In the concealed tank 1 is inserted a fitting body 7, whose transverse extension is somewhat smaller than the spacing between two flat surfaces 6 in the vicinity of the passage openings. The fitting body 7 is e.g. made from metal, whereas the concealed tank can be made from plastic.

The fitting body 7 is fixed in the concealed tank in that sleeve-like connecting elements 8 are inserted from the outside through the passage openings, said elements being made from sound deadening material, e.g. a rubber-like material. These connecting elements 8 are shaped like a cylindrical sleeve (i.e., they are at least partly tubular), whose external diameter and external shape correspond to the internal diameter and the shape of the passage openings of the concealed tank 1. On their radial outside 9 the connecting elements are provided with an outwardly directed flange 10, which prevents a sliding through the through openings.

The internal diameter of the sleeve-like connecting elements 8 corresponds to the external diameter of the sleeve-like lugs 11 of the fitting body. These lugs 11 are located inside the opening 12 of the connecting elements. They have their outsides in flat engagement on the insides of the openings 12 of the connecting elements 8. The material of the connecting elements 8 is chosen in such a way that the fitting body 7 is securely held by the connecting elements. As the front edges 13 of the lugs 11 extend up to the surfaces 6 in which the through openings are provided, a secure, sound-deadened connection is produced between the fitting body and the concealed tank 1. At no point is the fitting body 7 in contact with the concealed tank 1. The connection is solely provided by the connecting elements 8.

The fitting body has a planar surface 14 directed towards the open side 2 of the concealed tank 1 and in whose centre is provided a threaded bore 15 perpendicular to said surface 14.

The fitting body 7 contains four water ducts, which pass through the lugs 4 and issue into the planar surface 14. The four water ducts are separated from one another. The issuing openings 16 are e.g. circular.

Onto the fitting body 7 can be mounted a sanitary fitting, which has a mating surface corresponding to the surface 14. The two surfaces 14 and the mating surface need not be planar, but must be watched to one another. The sanitary fitting is fixed in the tapped hole 15. The sanitary fitting then has openings which can be made to coincide with the openings 16 in the surface 14. It is obviously possible not to use all the openings 16.

The concealed tank 1 with the arrangement of the fitting body 7, fixed with the aid of connecting elements 8, is then inserted in a recess of a wall or behind an insulating wall and connected to the house water supply pipe, whose connections are screwed into the lugs 11. Only after completing the installation, which e.g. can also undergo seal testing, and the subsequent production of the tiling is the actual fitting inserted in the concealed tank 1 and screwed to the body 7.

FIG. 2 is a plan view of the arrangement of FIG. 1. In addition to the already mentioned projections 5 with the fixing openings 17 located therein, on the outside of the concealed tank projections 18 are provided at a lower level together with the openings 19 therein. With the aid of these openings 19 in the projections the concealed tank can be screwed to the rear wall of a recess in the wall.

Outside the circular, planar surface 14 for the connection to the fitting, circumferentially and roughly centrally between the lugs 11 are provided further tapped openings 20, which in the same way as the tapped hole 15 can be used for screwing the fitting.

The four lugs 11 and correspondingly the four fixing elements 18 are uniformly circumferentially distributed and in each case are at right angles to the adjacent lug 11. As has already been stated, it is not necessary for all four water ducts to be used in a sanitary fitting. The unused water ducts can either be sealed by plugs or have no connection to the fitting. However, all four lugs 11 serve to bring about a sound-deadened connection of the fitting body to the concealed tank 1.

FIG. 1 shows that on the bottom 4 of the concealed tank a supporting device 21 is provided for each lug 11 of the fitting body and is constructed in one piece on the inside of the tank 1. In the embodiment shown the supporting device has a concavely curved element, whose upwardly curved surface 22, i.e. away from the bottom 4, corresponds to the curvature of the underside of the lug 11. During installation firstly the fitting body 7 is inserted in the concealed tank through its open side 2, the concealed tank 1 then being placed in the orientation shown in FIG. 1. The fitting body 7 with its four lugs 11 is then held by the mating surfaces 22 of the supporting device 21. In this position the lugs 11 are only slightly eccentrically positioned with respect to the passage openings through which the connecting elements 8 are now inserted from the outside. The connecting elements can also be inserted without any further measures to such an extent that their inner front ends 23 engage on the front edges 13 of the lugs 11. It is then merely necessary to tilt the fitting body 7 somewhat in order to be able to then insert the first connecting element. The sliding in of the further connecting elements can take place in a similar way by slightly tilting the fitting body 7. This tilting can e.g. be achieved in that a screw is screwed into the tapped hole 15 and can be grasped by the fitter.

However, to facilitate insertion, the inner edge of the end face 23 of the connecting elements 8 can be provided with a feed bevel 24. It is shown in the larger scale view of FIG. 4. The outside of the front edge 13 of the lugs 11 can also be provided with such a sloping surface 25. Both sloping surfaces can be dimensioned in such a way that the connecting element 8, on sliding through the passage opening, can move past the face 13 and then through the cooperation between the sloping faces 24, 25 the fitting body 7 can be raised and the lugs 11 can be concentrically centred to the passage openings and connecting elements 8. In this solution no manual intervention on the part of the fitter is necessary, so that an incorrect installation is not possible.

In a perspective section through the arrangement, FIG. 3 again shows how the connection takes place between the concealed tank 1 and the fitting body 7. In place of the passage openings, through the aforementioned modification to the thickness of the outer wall 3 on the inside and optionally also on the outside a planar or flat surface 6 is formed. This ensures that the front edges 13 of the lugs 11 of the fitting body 7 located in a single plane throughout have the same spacing from the inner face of the wall of the tank 1, so that they can throughout extend very close to said wall. Together with the corresponding choice of material and the stability of the connections, this helps to prevent the formation of sound bridges, which would facilitate a propagation of sound from the fitting to the tank and vice versa.

In the embodiment of FIG. 5, which is only described to the extent that it differs from the preceding embodiments, the bottom of the concealed tank 1 has a projection 30, which is constructed as an axial stud and is shaped onto the bottom. The fitting body contains a recess in the form of a blind hole, whose shape roughly corresponds to the shape of the projection 30. On the projection 30 is mounted a connecting element 31 in the form of an end-closed sleeve and on said connecting element 31 is then mounted or pressed the fitting body 7 with its blind hole. Prior to the insertion of the fitting body 7 in the concealed tank 1, said connecting element can either be firstly mounted on the stud 30 or firstly inserted in the blind hole.

The opposite end of the fitting body 7 with the screw connection can then be connected in the same way to the tank 1 as was described in conjunction with the preceding embodiments.

In the embodiment of FIG. 6 the bottom of the concealed tank 1 once again has a projection in the form of a stud 32. On the underside of the fitting body 7 is shaped an equally large stud 33, both studs being coaxial. The connecting element is in the form of a cylindrical sleeve with a partition. The connecting element 34 can firstly be connected to the stud 32 of the concealed tank 1 or firstly to the stud 33 of the fitting body 7. Once again the passage opening for the water can be connected with the aid of a connecting sleeve to the concealed tank 1.

If several such studs 32 are shaped onto the bottom of the concealed tank 1, use can be made of several connecting elements 34, which are optionally interconnected with a web in order to facilitate installation.

What is claimed is:

1. Fixing arrangement for sanitary components to carry water, comprising:

a container structured for concealed fitting into a wall of a building, the container having at least one open side, and being attachable to the wall;

a fitting body structured for insertion into the container from the open side;

at least one connecting element constructed from soundproofing material, wherein the connecting element supports the fitting body in the container and spaces the fitting body from direct contact with the container, said fitting body being solely supported in the container by said at least one connecting element;

wherein the connecting element is mounted in the container such that the fitting body is affixable to the connecting element after the connecting element is affixed in the container; and, wherein the connecting element fits in a passage opening through a wall of the container and bears against an edge of the container.

2. The fixing arrangement according to claim 1, wherein the connecting element supports the fitting body so as to position an opening of the fitting body at the passage opening of the container.

3. The fixing arrangement according to claim 1, wherein the connecting element is attachable to the container by insertion from outside of the container.

4. The fixing arrangement according to claim 1, wherein the connecting element comprises a hollow part that encloses around part of the fitting body.

5. The fixing arrangement according to claim 1, wherein the connecting element is constructed as a sleeve.

6. The fixing arrangement according to claim 1, wherein a connection between the connecting element and the fitting body takes place in an opening in the container.

7. The fixing arrangement according to claim 1, wherein the connecting element comprises an at least partly tubular sleeve-like part and the fitting body comprises a lug that engages in the sleeve-like part of the connecting element.

8. The fixing arrangement according to claim 1, wherein the fitting body comprises an at least partly tubular sleeve-like lug and the connecting element engages in said sleeve-like lug.

9. The fixing arrangement according to claim 1, wherein the container has a supporting device for the fitting body, which is so arranged and constructed that the fitting body is held in a vicinity of a final position thereof.

10. Fixing arrangement for sanitary components to carry water, comprising:

a container structured for concealed fitting into a wall of a building, the container having at least one open side, and being attachable to the wall;

a fitting body structured for insertion into the container from the open side;

at least one connecting element constructed from soundproofing material, wherein the connecting element supports the fitting body in the container and spaces the fitting body from direct contact with the container, said fitting body being solely supported in the container by said at least one connecting element;

wherein the connecting element is mounted in the container such that the fitting body is affixable to the connecting element after the connecting element is affixed in the container;

wherein the container has a supporting device for the fitting body, which is so arranged and constructed that the fitting body is held in a vicinity of a final position thereof; and, wherein the connecting element and the fitting body are structured and arranged such that the fitting body must be moved out of the supporting device to achieve engagement between the connecting element and the fitting body.

11. The fixing arrangement according to claim 1, wherein at least one said connecting element seals between the fitting body and the container.

12. Fixing arrangement for sanitary components to carry water, comprising:

a container structured for concealed fitting into a wall of a building, the container having at least one open side, and being attachable to the wall;

a fitting body structured for insertion into the container from the open side;

at least one connecting element constructed from soundproofing material, wherein the connecting element supports the fitting body in the container and spaces the fitting body from direct contact with the container, said fitting body being solely supported in the container by said at least one connecting element;

wherein the connecting element is mounted in the container such that the fitting body is affixable to the connecting element after the connecting element is affixed in the container; and, wherein the fitting body has water ducts.

13. The fixing arrangement according to claim 1, wherein the fitting body has an interface surface structured to fit with an interface surface of a sanitary fitting.

14. The fixing arrangement according to claim 1, wherein the fitting body has fixing openings for fixing sanitary elements.

15. Fixing arrangement for sanitary components to carry water, comprising:

a container structured for concealed fitting into a wall of a building, the container having at least one open side, and being attachable to the wall;

a fitting body structured for insertion into the container from the open side;

at least one connecting element constructed from soundproofing material, wherein the connecting element supports the fitting body in the container and spaces the fitting body from direct contact with the container, said fitting body being solely supported in the container by said at least one connecting element;

wherein the connecting element is mounted in the container such that the fitting body is affixable to the connecting element after the connecting element is affixed in the container; and, wherein the container has fixing holes for the fixing thereof to the wall of a building.

16. Fixing arrangement for sanitary components to carry water, comprising:

a container structured for concealed fitting into a wall of a building, the container having at least one open side, and being attachable to the wall;

a fitting body structured for insertion into the container from the open side;

at least one connecting element constructed from soundproofing material, wherein the connecting element supports the fitting body in the container and spaces the fitting body from direct contact with the container, said fitting body being solely supported in the container by said at least one connecting element;

wherein the connecting element is mounted in the container such that the fitting body is affixable to the connecting element after the connecting element is affixed in the container;

wherein the connecting element comprises an at least partly tubular sleeve-like part and the fitting body comprises a lug that engages in the sleeve-like part of the connecting element; and, wherein the lug of the fitting body is constructed for connection to a water pipe of a house plumbing system.

17. The fixing arrangement according to claim 1, wherein the connecting element is insertable in a recess defined in at least one of the fitting body and the container.

18. The fixing arrangement according to claim 1, wherein the connecting element is mounted on at least one projection provided on at least one of the fitting body and the container.

19. Fixing arrangement for sanitary components to carry water, comprising:

a container structured for concealed fitting into a wall of a building, the container having at least one open side, and being attachable to the wall;

a fitting body structured for insertion into the container from the open side;

a plurality of connecting elements constructed from soundproofing material, wherein the connecting elements support the fitting body in the container and space the fitting body from direct contact with the container, said fitting body being solely supported in the container by said connecting elements;

wherein the connecting elements are mounted in the container such that the fitting body is affixable to the connecting element after the connecting element is affixed in the container.

20. The fixing arrangement according to claim 19, wherein said connecting elements are of a plurality of different types.

* * * * *